United States Patent [19]

Lante-Montefeltro Della Rovere

[11] 4,218,061

[45] * Aug. 19, 1980

[54] REUSABLE TARGET PIGEON FOR AUTOLOADING LAUNCHER

[76] Inventor: Ludovico Lante-Montefeltro Della Rovere, Avenida Paez Quinta Ismenia, El Paraiso-Caracas, Venezuela

[ * ] Notice: The portion of the term of this patent subsequent to Jan. 9, 1996, has been disclaimed.

[21] Appl. No.: 892,921

[22] Filed: Apr. 3, 1978

[51] Int. Cl.[2] ..... F41J 9/16

[52] U.S. Cl. ..... 273/364; 273/365

[58] Field of Search ..... 273/105.4, 105.5, 127 A; 46/82, 83, 84, 85; 124/36, 43, 47

[56] References Cited

U.S. PATENT DOCUMENTS

| | | | |
|---|---|---|---|
| 462,691 | 11/1891 | Claggett | 273/105.4 |
| 3,572,714 | 3/1971 | Lau | 273/105.4 |
| 4,077,384 | 3/1978 | Montefeltro | 273/105.4 |
| 4,133,532 | 1/1979 | Rovere | 273/105.4 |

*Primary Examiner*—George J. Marlo
*Attorney, Agent, or Firm*—Karl F. Ross

[57] ABSTRACT

A target pigeon for use in an autoloading target-pigeon launcher has a generally flat and circular ring centered on a ring axis and having a continuous and uninterrupted circular inner periphery defining a circular open space, a substantially circular outer periphery, and a pair of opposite axial faces. Two diametrically opposite formations are provided on one of the face of the ring and are each formed with a radially inwardly open notch spaced from the inner periphery. Furthermore an axially projecting circular and continuous ridge is formed on the one face of the ring spaced between and from the inner periphery and the formations and formed away from the one face with the chamfer and at the formations with radially outwardly open cutouts. A pair of diametrically opposite vanes is provided on the rings at the holding formations, tipped propeller-fashion relative to each other. A witness cap has a substantially cylindrical rim centered on a cap axis and having one axial end engageable with the one axial face of the ring between the formations thereof and the ridge and formed with a substantially continuous outwardly projecting bead receivable in the notches of these formations. This cap also has an endplate perpendicular to the cap axis and extending across the other axial end of the rim. The cap and the ring are formed of an elastically deformable high-impact synthetic resin.

15 Claims, 4 Drawing Figures

REUSABLE TARGET PIGEON FOR AUTOLOADING LAUNCHER

FIELD OF THE INVENTION

The present invention relates to a target pigeon.

More particularly, this invention concerns such a pigeon which when rotated at high speed and released will propel itself through the air so as to provide a life-like substitute for live-bird shooting.

BACKGROUND OF THE INVENTION

A target pigeon of the so-called Pro ZZ type and a launcher therefor of the Montefeltro 75 type are known from commonly owned U.S. Pat. No. 4,077,384 issued Mar. 7, 1978 and filed June 3, 1976 as a continuation-in-part of abandoned application Ser. No. 604,069 filed Aug. 12, 1975, and from commonly owned and copending U.S. patent applications Ser. No. 762,019 filed Jan. 24, 1977 (now U.S. Pat. No. 4,133,532) whose disclosures are herewith fully incorporated by reference.

As described in the commonly owned and jointly filed application Ser. No. 892,922 entitled "Autoloading Target-Pigeon Launcher," whose entire disclosure is also herewith incorporated by reference, the above-described system, although a considerable improvement over the prior-art systems, nonetheless has several disadvantages. One of these disadvantages, namely that the launcher must be loaded by hand, is overcome by the machine described in this jointly filed application. This autoloading target-pigeon launcher is intended for use exclusively with the target pigeon described in this application hereinbelow.

The other failing of the known system relates to the separation of the propeller or body part of the target pigeon from the cap or witness disk thereof. It is important in normal target shooting, and essential in competition, that even an indirect hit on the witness disk or cap part result in separation of the two parts of the target for scoring. Nonseparation in case only one or two pellets strike the propeller part can be tolerated, but it is absolutely critical that any impacting of the central witness disk or cap part result in separation for scoring.

In the prior-art pigeons there is a web which extends across the ring part of the body. It is a relatively frequent occurence that a pellet fired from behind and below at a pigeon flying away from the shooter strikes this web part only, and does not cause separation, but merely presses the propeller part more tightly against the cap part. This web is essential in the prior-art pigeons for holding the pigeons on the launcher. Another common occurrence with the prior-art pigeons is that a pellet strikes the ring part of the witness disk which extends somewhat up and around the cap part so as to deflect the pellet, preventing a direct hit and also not impacting the cap part for separation of the pigeon into two pieces. Thus what happens is the propeller part of the pigeon shields the cap or part and prevents what should be a scoring impact from causing separation of the disk from the propeller part.

Another disadvantage of the known target pigeons, in particular of the reusable ones made of high-impact synthetic-resin material, such as described in the commonly owned and copending application Ser. No. 882,907 filed Mar. 1, 1978, whose entire disclosure is also herewith incorporated by reference, is that their reassembly requires the user carefully to reline the feet and various axially extending projections of the disk and propeller part with each other. Unless these various projections are exactly aligned prior to reuse of the pigeon, it is likely that the pigeons will come spontaneously apart when spun by the launcher for a misfiring.

OBJECTS OF THE INVENTION

It is therefore an object of the present invention to provide an improved target pigeon.

Yet another object is to provide such a pigeon which is ideally suited for use with the autoloading launcher of the commonly owned and jointly filed application cited above.

A further object is to provide such a pigeon which can be easily assembled after separation.

A further object of the instant invention is the provision of the target pigeon which will separate readily when the cap is impacted, and wherein the possibility that a potential hit is deflected from the cover disk by the propeller part is greatly reduced.

SUMMARY OF THE INVENTION

These objects are attained according to the instant invention by the target pigeon comprising a substantially circular ring centered on a ring axis and having a substantially circular and continous inner periphery defining a substantial circular and completely open space adapted to receive a cylindrical launch tip of a launch head and a substantially circular outer periphery. A plurality of substantially angularly equispaced radially extending vanes tipped propeller-fashion to one another are formed unitarily with this ring. A cup-shaped witness cap having a substantially circular rim centered on a cap axis and having an axially directed end engageable with the ring between its peripheries and an opposite axially directed end bridged and closed by an end plate extending across the rim at opposite end thereof. Means is provided including interengaging formations on the rim and on the ring for releasably securing same together with the axis aligned and the one end of the rim bearing on the ring between its peripheries, and for freeing the cap and the ring from each other when the cap is impacted.

Thus in accordance with the instant invention no web is provided across the ring. The open space thus left not only allows the target to be used by an autoloading pigeon launcher, but also ensures that any shots from behind will contact the endplate or the inside of the rim of the cap for absolutely certain separation. In practice it has been found that the vast majority of the shots do indeed impact on the concave under side of the cap.

Furthermore according to this invention the cap is rotationally cylindrical about its axis, so that one of the formations that holds it on the ring is constituted as a bead projecting radially inwardly or outwardly on the rim of the cap. The formations on the ring that interact with this bead may be constituted as a pair of small lugs each formed with a radially directed notch that receives the bead. The ring and/or the cap are formed of elastically deformable material, such as a high-impact sythetic resin, so that a snap fit between the two is possible. Furthermore according to this invention the two lugs can be provided on the outside and can have a very small angular dimension so that virtually the entire exterior of the cap is exposed. In addition the axially symmetrical cap can be fitted in any angular position to the propeller part so that reassembly is extremely easy and can hardly go wrong.

According to another feature of this invention there is formed to one radial side of the disk a centering ridge. Normally this ridge is provided between the inner periphery of the ring and the rim of the disk when the pigeon is assembled. In this case the outer diameter of the centering ridge corresponds substantially to the inner diameter of the rim of the cap, and the outer surface is chambered at its end away from the ring so that the disk can be easily snapped in place. Advantageously this ridge is cut away opposite the holding formations to permit deflection of the rim in these regions.

The target pigeon of this invention has in accordance with further features a substantially cylindrical cap which is stepped and has a control cylindrical projection constituting part of its endplate which has an outer diameter equal to slightly less than the inner diameter of the inner periphery of the ring part. Furthermore the projection extends beyond a plane defined by the upper edges of the vanes and the end plate between the projection and the outer rim. Thus the projection of one target pigeon can fit neatly into the ring of an underlying pigeon in a stack of upside-down pigeons such as in the autoloading launcher of the above-cited jointly filed application. The opposite side of the target pigeon is defined by the plane of the other axial face of the ring and the other edge of the vanes.

The pigeon according to the instant invention is adapted for use in a launching machine having a launch head which can be rotated about an axis on a frame above a vertically displaceable platform adapted to support a stack of the target pigeons according to this application, and which is pivotal about a horizontal swivel axis between a launch position with the tip of the launch head directed generally upwardly and a load position with the tip directed downwardly at the platform. The platform can be vertically stepped for displacing the stack of pigeons thereon upwardly and for fitting the uppermost pigeon of the stack over the tip of the launch head when same is in the launch position. Holding means in the form of radially retractable fingers is provided on the tip for releasably securing the pigeon whose ring has been fitted over the normally cylindrical tip thereto. According to further features of this system the tip is provided with a beak that is displaceable relative to the cylindrical upper surface of the tip between an outer position projecting radially from the tip and oriented to deflect a pigeon moving along the head axis off the tip and an inner position retracted into the tip. Retraction means is provided for displacing this beak into the inner position when the head is in the loading position.

Thus in accordance with the sytem in which the pigeon of this invention is used the uppermost pigeon of the stack on the platform is pressed against the launching head whose beak is retracted, so that the fingers of the launch head can engage over the inner periphery of the ring of the target pigeon and positively hold this target pigeon in place. The launch head is then pivoted around and directed upwardly while its drive is actuated to spin the target pigeon at a relatively high speed of up to 8000 rpm. Such spinning centrifugally drives the deflecting beak radially outwardly. The fingers can then be retracted by means of a solenoid built directly into the launch head so that further expulsion elements on the launch head push the pigeon off so that it will then slide over and be deflected by the beak but, due to its high-speed rotation, will nonetheless propel itself upwardly away from the launcher.

In practice the concave backside of the cap is normally turned toward the shooter or in some cases the pigeon is sideways. Hardly ever is the endplate of the cap turned directly toward the shooter. In any case, however, a hit will result in separation of the two parts from each other as any shot from behind will impact a pellet on the concave under side of the cap and immediately knock it off the propeller part. Any shot from the side will similarly strike the cover part, which is fully exposed at its sides, and cause separation.

Thus the system according to the present invention allows the target pigeon to be used in an autoloading machine. Furthermore the pigeon can be very easily reassembled after it is knocked apart. Finally virtually any impacting of the cover disk will result in separation so that the pigeon is ideally suited for accurate competition shooting.

SPECIFIC DESCRIPTION

Figure 2:
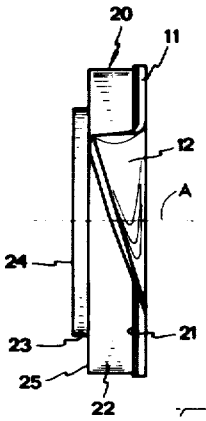
FIG. 2 is an end view of the pigeon according to this invention.
Figure 1:
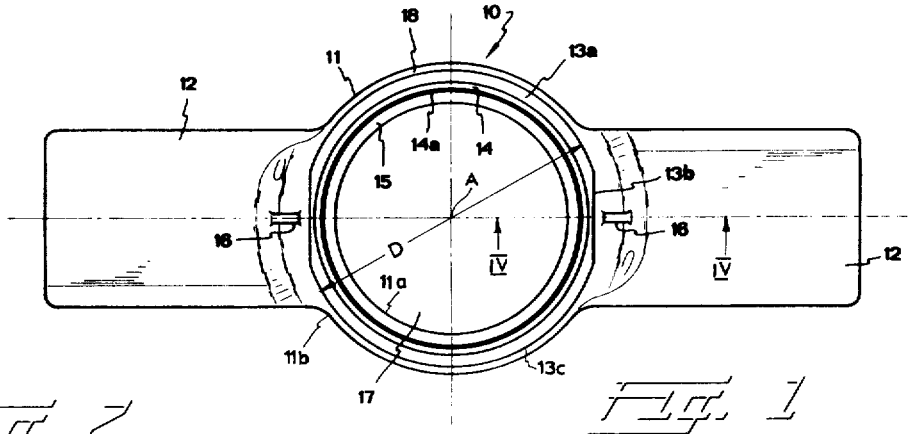
FIG. 1 is a top view of the propeller or body part of the pigeon according to this invention.
Figure 3:
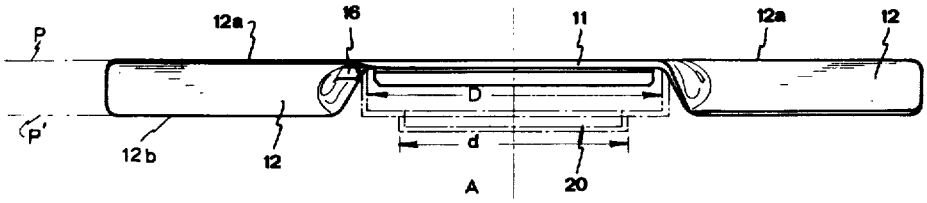
FIG. 3 is a side view of the body part according to this invention with the witness part shown in dot-dash lines.
Figure 4:
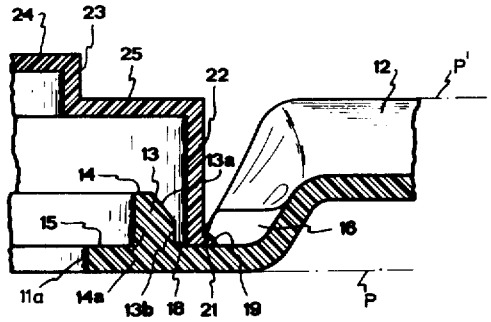
FIG. 4 is a large-scale section taken along line IV—IV of FIG. 1.

As shown in FIGS. 1–4 the target pigeon according to the instant invention consists basically of a propeller or body part 10 on which is mounted a witness or cap part 20. Both parts are made of durable material, either a light metal or alloy, or a high-impact synthetic resin. A polycarbonate such as Lexan, a polystyrol, a polyester-filled softboard, an ABS elastomer, or the like can be used. It is important that the material constituting the parts 10 and 20 have some elasticity and high impact resistance.

The body part 10 lies completely between a pair of parallel planes P and P' and basically comprises a flat circular ring 11 having a circular inner periphery **11*a* and a circular outer periphery 11*b* both centered on an axis A, and a pair of propeller vanes 12 extending from this outer periphery 11*b*. The vanes 12 are tipped propeller-fashion opposite each other so that each vane has a lower edge 12*a* lying on the plane P and an upper edge 12*b*** lying on the plane P'.

On its upper face the ring 11 is provided with a circularly annular ridge 13 having an end face 14 lying in a plane parallel to the planes P and P' and a cylindrically circular inner face **14*a* spaced a short distance from the inner periphery 11*a* to leave an annular portion 15 of the ring exposed. In addition the ridge 13 has an outer face 13*c* formed adjacent the end face 14 with a chamfer 13*a* and formed at each of the vanes 12 on diametrically opposite sides with cutouts or flats 13*b*. Otherwise the outer surface 13*c* is cylindrical and centered on the axis A. This outer surface 13*c*** has a relatively large diameter D.

In addition the propeller part 10 is formed at the base of each of the vanes 12 with a short upstanding holding lug 16 having on its radially inner edge a notch 19 immediately adjacent the upper surface of the ring 11. An annular portion 18 of this upper face is exposed all around the ridge 13 between the holding formations or lugs 16 and the outer surface **13*c***. In addition the entire central space 17 defined by the inner periphery 11*a* is completely empty; there is no web or any other traversing part of the ring 11.

The cap 20 is cup shaped and, although it can be of simple cylindrical closed shape, is here shown to be stepped. Thus this cap 20 has an outer rim 22 whose lower edge is formed with an outwardly directed bead 21. A central circular part 24 is connected via a cylindrical wall portion 23 to a flat circularly annular portion 25 having an outer periphery connected with the other upper end of the wall portion 22. The rim or wall 22 has an inner diameter equal to the diameter D. Thus the part 20 can be fitted snugly over the ridge 13, with the cutouts 13*b* allowing limited elastic deformation of the wall 22 so that the bead 21 can snap at both sides into the notches 19.

Furthermore the projection constituted by the end wall 24 and the connecting cylindrical wall 23 lies above the plane P' and has a diameter d which is equal to slightly less than the diameter of the inner periphery 11*a*. This dimensioning allows the target pigeons to be stacked one on top of the other with the projections 23, 24 of one pigeon extending into the ring 11 of the adjacent pigeon.

The cylindrical launch tip of a launch head has a diameter equal to slightly less than the diameter d. When engaged with the target pigeon according to this invention its retractable fingers can engage over the portion 15 and hold it securely on the launcher, tightly enough that the rotation of the launch head will be imparted to the pigeon without the necessity of providing axially interengaging formations for transmitting this torque. The radial dimension of the portion 15 is also sufficient to allow the beak to project without striking the centering ridge 13 that serves mainly for stiffening the pigeon and for aiding in its assembly.

The large open circular space 17 at the underside or back of the pigeon ensures that any pellets fired at the pigeon from the back will be able to strike the underside of the cap 20 to separate it easily from the propeller part 10. What is more the entire outer surface of the rim 22 and of the wall portion 23 is exposed, except for the very small region covered by the holding lug 16. Thus an impact from the side will also strike the cover part 20 rather than being deflected by any portion of the body part 10 and will ensure separation also.

I claim:

1. A target pigeon comprising:

a substantially circular ring centered on a ring axis and having a substantially circular and continuous inner periphery defining a substantially circular and completely open space adapted to receive a launch tip of a launch-head and a substantially circular outer periphery;

a plurality of substantially angularly equispaced radially extending vanes tipped propeller-fashion;

a cup-shaped witness cap having a substantially circular rim centered on a cap axis and having an axially directed end engageable with said ring between said peripheries thereof and an opposite axially directed end, and an end plate extending across and closing said rim at said opposite end thereof; and means including interengaging formations on said rim and on said ring for releasably securing same together with said axes aligned and said one end of said rim bearing on said ring between said peripheries thereof and for freeing said cap and ring from each other when said cap is impacted.

2. The target pigeon defined in claim 1 wherein said cap is rotationally symmetrical about said cap axis.

3. The target pigeon defined in claim 2 wherein said interengaging formations include a continuous radially projecting circular bead on said opposite end of said rim.

4. The target pigeon defined in claim 3 wherein said interengaging formations include at least two angularly spaced and radially open notches on said ring in which said bead is receivable.

5. The target pigeon defined in claim 4 wherein said rim is elastically deformable sufficiently to displace said bead out of said notches.

6. The target pigeon defined in claim 1 wherein said ring is formed with an axially protecting ridge receivable to one radial side of said opposite end of said rim when said cap and said ring are secured together.

7. The target pigeon defined in claim 6 wherein said ridge has an outer diameter substantially equal to the inside diameter of said opposite end of said rim.

8. The target pigeon defined in claim 7 wherein said interengaging formations include a continuous radially outwardly projecting bead on said opposite end and at least two angularly spaced and radially inwardly open notches on said ring in which said bead is receivable, said ridge being formed with cutouts reducing its said outside diameter at said notches.

9. The target pigeon defined in claim 7 wherein said ridge has an outer surface which is formed with a chamfer.

10. The target pigeon defined in claim 7 wherein said ridge is spaced outwardly of said inner periphery of said ring.

11. The target pigeon defined in claim 1 wherein said rim is cylindrical and is centered on said cap axis.

12. The target pigeon defined in claim 11 wherein said cap is stepped and has at said end plate an upstanding generally cylindrical projection.

13. The target pigeon defined in claim 12 wherein said vanes have upper edges lying in a plane perpendicular to said axis and said cylindrical projection extends beyond said plane.

14. The target pigeon defined in claim 13 wherein said cylidrical projection has an outer diameter at most equal to the inner diameter of said inner periphery, whereby said pigeons can nest together with the cylindrical projection of each cap engageable within the space of the ring of the overlying pigeon.

15. A target pigeon comprising:

a generally flat and circular ring centered on a ring axis and having a continuous and uninterrupted substantially circular inner periphery defining a circular open space, a substantially circular outer periphery and a pair of opposite axial faces;

at least two angularly generally equispaced formations on one of said faces of said ring each formed with a radially inwardly open notch spaced from said inner periphery; an axially projecting substantially circular and continuous ridge on said one face of said ring spaced between and from said inner periphery and said formations and formed away from said one face with a chamber and at said formation with radially outer cutouts;

a pair of diametrically opposite vanes on said ring projecting generally from said outer periphery thereof and tipped propeller-fashion relative to each other;

a cap having a substantially cylindrical rim on a cap axis and having one axial end engageable with said one axial face between said formations and said ridge and formed with a substantially continuous outwardly projecting bead receivable in said notches, and an end plate perpendicular to said cap axis and extending across the other axial end of said rim, said cap and said ring being formed of an elastically deformable synthetic resin.

* * * * *